US008875837B2

(12) United States Patent
Moore et al.

(10) Patent No.: US 8,875,837 B2
(45) Date of Patent: Nov. 4, 2014

(54) VIBRATION-DAMPENING MUSICAL PERFORMANCE RISER

(71) Applicant: Rain/Moore Company, LLC, Nashville, TN (US)

(72) Inventors: Thomas Moore, Hackettstown, NJ (US); Charles Nelson, Lebanon, TN (US); Gary Messisco, Annville, PA (US)

( * ) Notice: Subject to any disclaimer, the term of this patent is extended or adjusted under 35 U.S.C. 154(b) by 0 days.

(21) Appl. No.: 14/058,842

(22) Filed: Oct. 21, 2013

(65) Prior Publication Data

US 2014/0138180 A1 May 22, 2014

Related U.S. Application Data

(60) Provisional application No. 61/816,090, filed on Apr. 25, 2013, provisional application No. 61/717,295, filed on Oct. 23, 2012.

(51) Int. Cl.
*E04B 1/00* (2006.01)

(52) U.S. Cl.
USPC ..... 181/285; 181/30

(58) Field of Classification Search
USPC ..... 181/285, 30
See application file for complete search history.

(56) References Cited

PUBLICATIONS www.featherblock.net (last visited Jan. 23, 2014).

*Primary Examiner* — Forrest M Phillips
(74) *Attorney, Agent, or Firm* — Waters & Oppenhuizen PLC; John A. Waters

(57) ABSTRACT

A musical performance riser having an interior area and a rigid block made from multiple layers of foam material of varying densities incorporated within that area. The block further includes a number of holes or chambers to trap sound. When the riser is used in performances, sound waves created by the object placed on the riser are reduced or dissipated as they travel down the block through the foam layers and chambers with the result being reduced acoustic interference and a better listening experience for the audience. The riser also includes specialized removable casters supported against rubber isolation feet that further serve to reduce the unwanted interference.

20 Claims, 5 Drawing Sheets

VIBRATION-DAMPENING MUSICAL PERFORMANCE RISER

CROSS REFERENCE TO RELATED APPLICATIONS

This application claims the benefit of U.S. Provisional Application No. 61/816,090, filed Apr. 25, 2013, and U.S. Provisional Application No. 61/717,295, filed Oct. 23, 2012, the entire disclosure of both of which are incorporated herein by reference for all purposes.

FIELD OF THE INVENTION

The present invention is directed to a musical performance riser, in particular to a performance riser that reduces unwanted vibrations by employing foam materials, sonic suppression chambers, and an improved caster assembly.

BACKGROUND OF THE INVENTION

Musical performance risers are well known in the performing arts and are often used by individuals or groups during musical or dramatic performances in a number of settings including schools, churches, theaters, concert halls, stadiums, etc. These risers are helpful in raising individual performers as well as groups of performers, and/or their instruments or equipment (e.g. speakers, amplifiers, microphones, etc.), off of the ground or lower stage.

One problem with most risers on the market today is that they almost never reduce the unwanted vibrations that can occur during a musical performance and often actually make the problem of unwanted vibrations worse. When a performer uses equipment or instruments on traditional risers, the vibrations can travel through these risers and down into the stage, floor, or ground, then out into the audience. These vibrations cause interference with the music being produced and reduce the quality of the audience's listening experience.

Various attempts have been made to reduce the impact of these unwanted vibrations. One common tool used is to place a shield around the performer in an attempt to block some of the direct sound transmission levels. This, however, can cause its own problems and does nothing to solve the issue of downward vibratory transmission.

At least one group has attempted to solve this problem by creating a riser supported by numerous metal rods and filled with a single type of foam material of uniform density. The use of this riser has proven unsatisfactory, however, as the metal rods which are required to support this otherwise flimsy riser effectively transmit vibrations themselves, therefore diminishing or negating any benefit from the foam inside. Furthermore, the fact that the foam material is all of a single type and density greatly reduces the effectiveness of this design.

Another problem that musicians face often occurs during concerts. In these situations, it is common for two or more acts to use the same stage, one after the other. Between each act, there is often significant time wasted during stage set-up and teardown. As one band leaves the stage, the members of the band or others remove all of the band's equipment and disconnect various components and cables. Then the equipment for the next band has to be set-up and positioned. In most concerts this all occurs over a lengthy period of time during which fans wait impatiently for the music to continue.

What is needed is a musical performance riser which has an improved ability to reduce unwanted vibrations during a musical or dramatic performance.

What is also needed is a musical performance riser which has improved ability to be moved to and from a stage efficiently, that can be set up and torn down quickly, while at the same time reducing unwanted vibrations.

SUMMARY OF THE INVENTION

One aspect of the present invention is the use of multiple layers of dissimilar densities of foam, and sonic suppression chambers cut out of those foam layers to create rigid blocks that are useful for reducing the transference of sound vibrations or heat waves.

Another aspect of the present invention is the use of these rigid blocks in musical performance risers that are capable of reducing unwanted vibrations. Such a riser includes a top surface, a bottom surface, and one or more side surfaces connecting the top and bottom surfaces and forming an interior area within the riser. The rigid block is positioned within that interior area and includes several layers of foam that have differing densities from each adjacent layer. More specifically, this riser serves to inhibit or eliminate the propagation of sound pressure waves emanating from any source, whether in direct physical contact with the riser or localized above the top surface of the riser, and downward vertical movement of these waves as well as outward expansion throughout the horizontal plane within the riser. The layers further include sonic suppression chambers which serve to trap and dissipate the sound that travels through the riser when it is in use. These strategically designed and positioned chambers are contour-cut into the foam materials. Ideally, this construction provides all of the elements of a classic recording studio sound control partition—absorption, diffusion, decoupling, and bass trapping—within the form of a durable and highly portable stage riser.

Another aspect of the present invention is the use of integral lighting and an interface plate in a riser such that the riser is able to simplify the attachment and adjustment of electronic and power distribution and connections during set-up and teardown.

Another aspect of the present invention is the use of a traditional anvil-style solid reusable storage and travel case with one or more inverted latch sets such that the case can be used in new ways and combined with other like cases.

Another aspect of the present invention is the incorporation of a traditional solid reusable storage and travel case into a riser in order to improve the riser's durability and ease of mobility.

Another aspect of the present invention is the use of casters in conjunction with rubber isolation feet, both to reduce unwanted vibrations and to improve the mobility of performance risers. In this aspect there is a receiving part that includes a top portion and a bottom tube. The top portion is attached on or embedded into the bottom of a riser and the bottom tube portion extends downwardly from the top portion. Connected to each receiving part is a pliable foot that has a central hole that can slide up around each bottom tube and a top surface of the pliable foot that can be positioned against the bottom of the riser once the bottom tube is slid through the central hole. A caster is then reversibly insertable within a corresponding bottom tube. Once all casters are inserted, the vertically-oriented riser is repositioned to a horizontal orientation, enabling movement and positioning onstage both before and after instrument and equipment placement. When ready for use in a performance the casters can remain attached; alternatively the risers can be positioned and used without these removable casters, by instead resting solely on the pliable feet.

Another aspect of the present invention is the use of multiple performance risers with casters to reduce the delay time in between each performance at a concert.

These and other aspects of the present invention will be more fully understood following a review of the specification and drawings.

DETAILED DESCRIPTION

Figure 1:
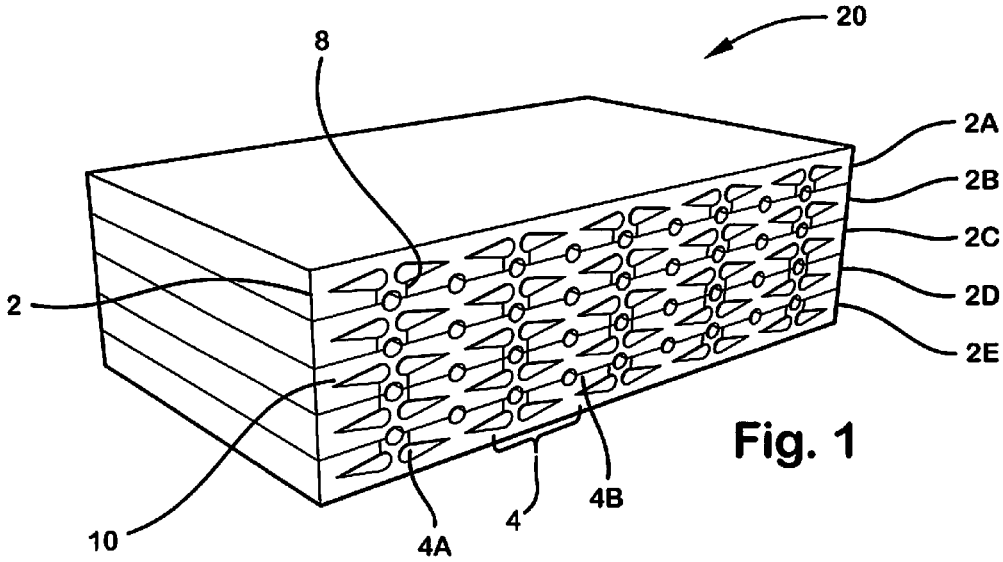
FIG. 1 is a perspective view of a multi-layer block of the present invention.

Referring to FIG. 1, the rigid block 20 used in one embodiment of the invention is shown. The block 20 as shown is a substantially rectangular prism; however, other shapes such as cylinders, cubes, and even other irregular shapes are contemplated. The block is made from layers 2 of foam material. Here, five layers (2A, 2B, 2C, 2D, and 2E) are shown and the foam material used in all of the layers 2 is expanded polystyrene (EPS). This foam material is preferred partially because of its relatively high density and rigidity, which means that it is capable of supporting significant weight independently from any accompanying enclosure.

In one embodiment of the invention, to increase the vibration-reducing properties of the block 20, each layer 2 of EPS is ideally of a different density than the layers 2 adjacent to it. This gradation of densities helps to reduce vibrations by causing multi-farious shifts in the direction of the sound waves that travel through the block 20, thereby decreasing or eliminating any sonic energy ultimately transferred downwards. In the embodiment of FIG. 1, for example, the layers 2 alternate densities between higher and lower density EPS down the block 20. In this embodiment, the density of each layer 2 varies by a factor of plus or minus two as compared to its immediate neighbor layers 2. Layers 2A, 2C, and 2E all have equal densities, and are twice as dense as layers 2B and 2D. In another embodiment, the densities of the EPS in the layers 2 are decreased moving down the layers 2, with the top layer 2 being the densest. In yet another embodiment, the ordering is reversed, with the densities of the layers 2 increasing going down the layers 2. The densities of the foam used for the layers is preferably between 4 kg/m3 and 660 kg/m3 with the densities ideally being between 16 kg/m3 and 45 kg/m3.

In the embodiment shown, the layers 2 of the rigid block 20 are substantially flat on their top and bottom surfaces and of uniform thickness of about two and three-quarter inches over their entire surface areas. Also, in the embodiment shown, each of the layers 2 has the same overall dimensions as the other layers 2. Other thicknesses and dimensions are contemplated. In addition, the concept of non-uniform thicknesses within layers 2 and layers 2 of that are of differing thicknesses or dimensions than their neighboring layers 2 are also contemplated.

The block 20 also contains a number of holes or chambers 4 referred to as sonic suppression chambers 4. These chambers 4 serve to trap and dissipate sound waves as they travel through the block 20. The shape of the holes as shown in FIG. 1 are horizontal raindrops of inverted directions 4A and circles between the layers 4B. In this embodiment, the chambers 4 each span from a location on a front face 10 of the block 20 to the corresponding location on a rear face of the block 20, with the vertical cross-sections of each chamber 4 remaining consistently shaped from end to end and with each chamber 4 remaining horizontally level over the entire distance. In the preferred embodiment, the raindrop-shaped chambers 4A are encompassed within the layers 2 and the circular shaped chambers 4B are made between the layers 2 of foam. Other shapes and patterns of holes or chambers 4 are also contemplated.

The block 20 is made by stacking layers 2 of EPS on top of each other. Before the EPS layers are stacked, the sonic suppression chambers 4 are cut with a hot-wire cutter. The cutter is controlled by a standard automated CNC machine. Because of the nature of the cutter, a small slit 8 is made in each raindrop-shaped chamber 4A. These cuts, which extend from the front face 10 to the rear face of the block 20, help to act as a release valves for excess vibration within a given layer 2 of foam. The slits 8 allow the vibrations to dissipate into other chambers 4 and levels of foam. Optionally, glue can be added to the EPS layers during stacking to help insure that the layers do not shift during transport and use.

This rigid block 20 of stacked layers 2 should be useful in many areas where vibration reduction or heat transference reduction are desirable. Such uses might include building insulation, for example. Similarly, the foam layers 2 could be used to pad the walls of a room to create better acoustics within the room. Also, the rigid blocks 20 could be used (possibly in conjunction with other materials described herein) in the construction and use of large stages and platforms.

One of the most significant uses of the block 20 is that it can be used as part of a versatile and easily transportable musical performance riser. In one preferred embodiment, the riser is small riser called an amp riser 40.

Figure 2:
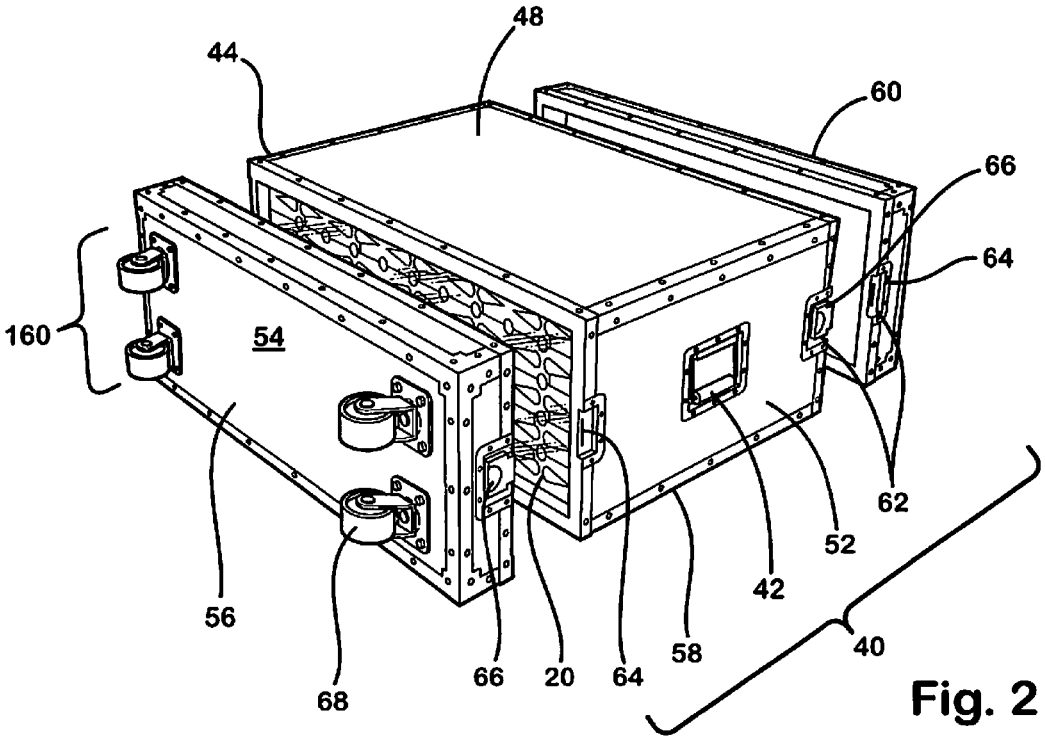
FIG. 2 is a partially-exploded perspective view of an amp riser of the present invention.
Figure 3:
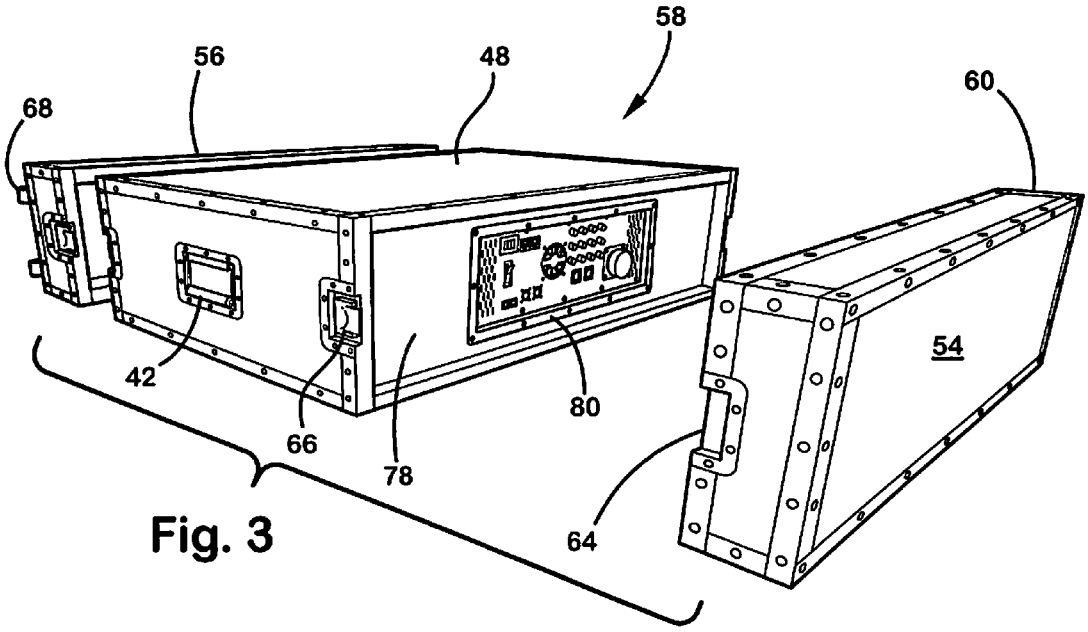
FIG. 3 is a second partially-exploded perspective view of the amp riser of FIG. 2.
Figure 4:
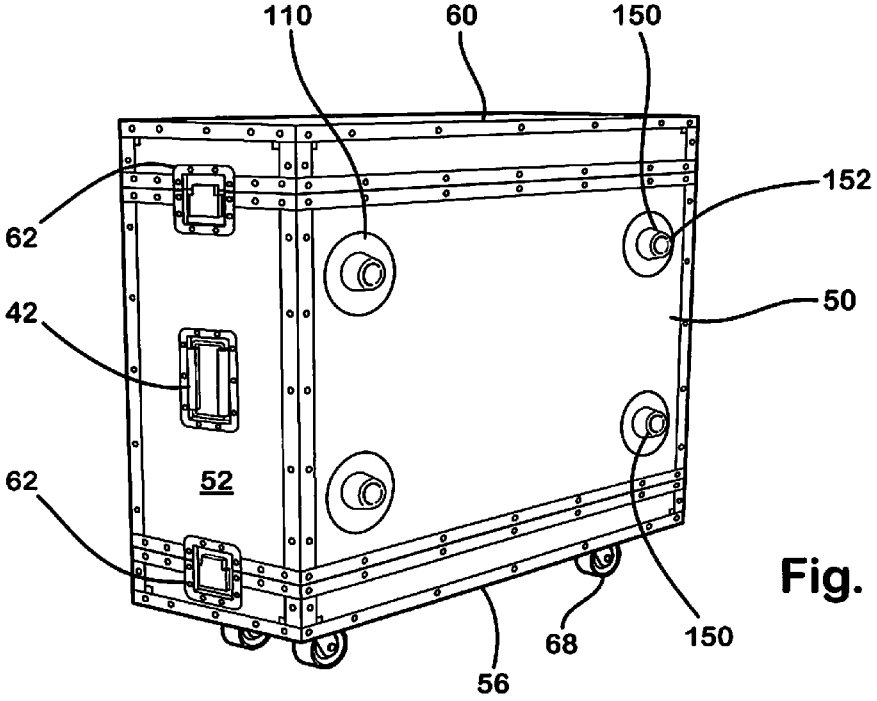
FIG. 4 is a perspective view of the amp riser of FIG. 2.

As shown in FIG. 2, in the amp riser 40, a rigid block 20 is surrounded by hard casing material. In the preferred embodiment the case 44 is made similar in style to other cases made by the Anvil Company and others, which are commonly used in the music industry.

In the preferred embodiment, the hard case 44 is substantially a rectangular prism, the six faces (top face 48, bottom face 50, two short side faces 52, and two long side faces 54) of the hard case 44 are made from fifteen thirty-seconds of an inch plywood, which is covered on the outer face by a thin black quad ripple polypropylene material. The faces are held together by a number of clamps screwed into the edges between the faces. Each corner of the hard case 44 is covered by a steel cover. Each of the edges of the hard case is covered by an angle iron. Along the top face 48 and bottom face 50, F-channels are used to cover the edges. Each of the two short side faces 52 contains a handle 42.

In the preferred embodiment, each amp riser 40 has a bottom lid 56, main portion 58, and top lid 60. The two lids 56, 60 are joined at opposite faces of the main portion 58 such that each lid 56, 60 has one of the two long side faces 54 on its exterior. Each lid 56, 60 is connected to the main portion 58 by two latches 62 (with one latch 62 per lid 56, 60 positioned each short side face 52). The latches 62 are significant in that latches 62 for connecting the bottom lid 56 to the main portion 58 have the male portion 66 of each latch 62 attached to the lid 56 and the female portion 64 of the latch 62 attached to the main portion 58. The latches 62 on the top lid 60 are reversed (with the male portion 66 connected to the main portion and each female portion 64 connected to the lid 60). This can have significant advantages for storage and combining riser sections as is described below. Additionally, this makes it possible for the bottom and top lids 56, 60 to be connected together via their corresponding latches 62 for storage purposes if desired. A similar result would be achieved if the orientation of all of the latches 62 on the riser 40 were reversed. In another embodiment, not shown, along the four connection edges between each lid 56, 60 and the main portion 58, a tongue and grove valance is used to insure a secure fit when the lids 56, 60 are connected to the main portion 58.

The outside of the bottom lid 56 (i.e., one of the long side faces 54) has attached four standard casters 68.

Inside the top lid 60 are two steel T-bars and two PVC quick clips. These devices provide spots for conveniently storing various cables and power cords that may be required to use the amp riser 40.

The amp riser 40 also has a transparent face 72 positioned as one of the faces of the main portion 58 of the riser 40, directly above the bottom lid 56. The transparent face 72 will ideally be made from an acrylic panel and will also have an EPVC panel positioned behind the acrylic panel, but before the rigid block 20, which is itself housed in the main portion 58 and takes up substantially all of the area within the main portion 58. In the preferred embodiment, the EPVC panel will be cut with a CNC Router Cutter prior to placement in the riser, such that a design is formed in the EPVC panel. For added style, the acrylic panel can optionally be etched with wording, logos, or designs.

The main portion 58 of the amp riser 40 also has a control panel face 78 that is located directly opposite the transparent face 72 and beneath the top lid 60. The control panel face 78 has an interface plate 80 integrated into the outside portion of it, which is described below.

Figure 5:
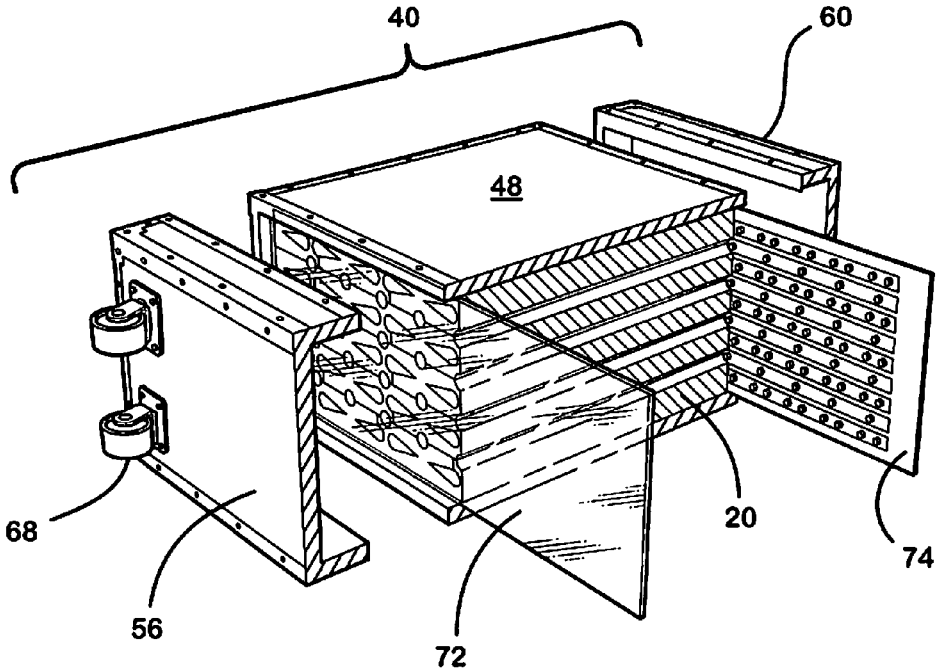
FIG. 5 is a partially-exploded perspective view of a vertical cross-section of the amp riser of FIG. 2.

Additionally, the main portion 58 of the amp riser 40 has an integral lighting system. As shown in FIG. 5, the integral lighting system includes an LED panel 74 located on the inside portion of the control panel face 78. The LED panel 74 is connected, either directly or through wiring, to the interface plate 80. Light from the LED panel 74 is visible through the transparent face 72 when the LED panel 74 is turned on.

Figure 11:
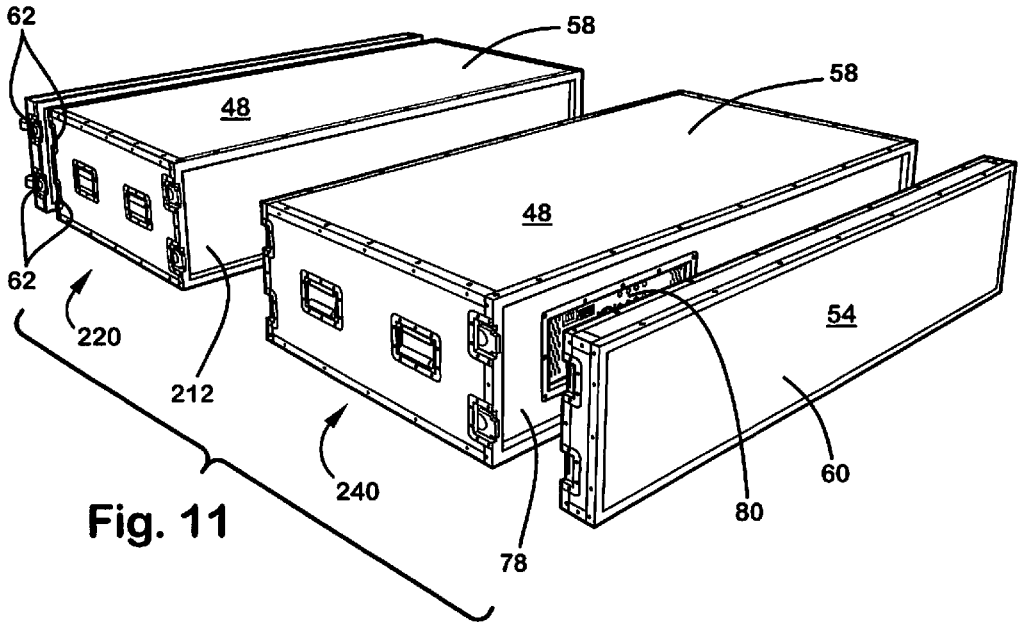
FIG. 11 is a second partially-exploded perspective view of the performance riser of the present invention.

The interface plate 80 described above is also shown in FIG. 11. The plate 80 ideally is used to house the interface points for the electronic and acoustic systems incorporated into the riser 40. Most of the parts in the interface plate 80, such as electrical outlets and other plug-ins, and their uses are well-known to those with ordinary skill in the art. Optionally, the plate 80 can include a utility light that is ideally located on the upper portion of the interface plate 80 and serves to light the other parts of the plate in dark settings. In addition, a fan can be included to reduce the possibility of overheating of electronic components.

Another significant feature of the amp riser 40 is the use of detachable wheels 100. In use, the bottom face 50 of the riser 40 has a plurality of detachable wheels 100 spaced about the surface 50. After lowering the riser 40 to a horizontal orientation, these detachable wheels 100 allow the riser 40 to be moved about a stage surface with ease.

Figure 6:
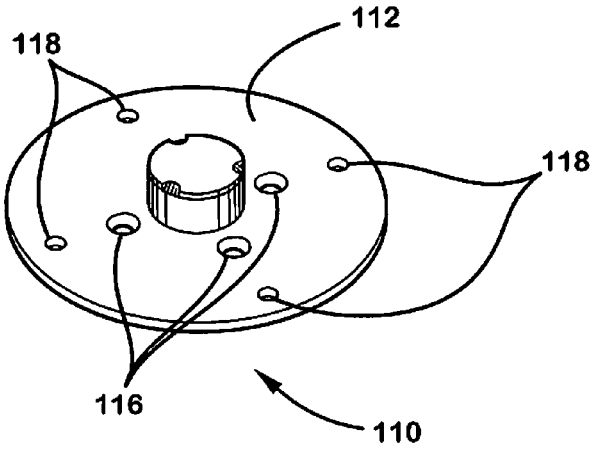
FIG. 6 is a perspective view of the caster plate of the present invention.
Figure 7:
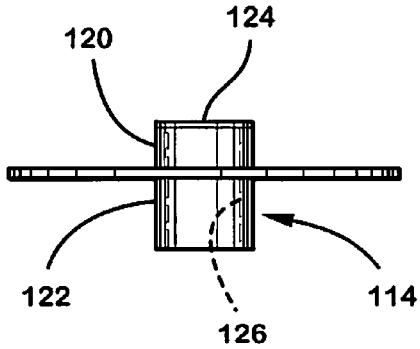
FIG. 7 is a second perspective view of the caster plate of FIG. 6.

In one embodiment, each detachable wheel 100 includes a caster plate 110, rubber isolation foot 150, and expanding-stem caster 140. As shown in FIG. 6, the caster plate 110 includes a solid disc 112 of four inches in diameter. The disc 112 has a hollow cylinder 114 located in its center, an inner ring of four equally-spaced large screw holes 116, and an outer ring of four equally-spaced small screw holes 118. The hollow cylinder 114 includes a top portion 120 that is positioned above the disc 112 and a bottom portion 122 positioned below the disc 112. The top portion is capped by end cap 124. The cylinder 114 also defines a receiving socket 126 with an inner diameter of three-quarters of an inch.

Figure 8:
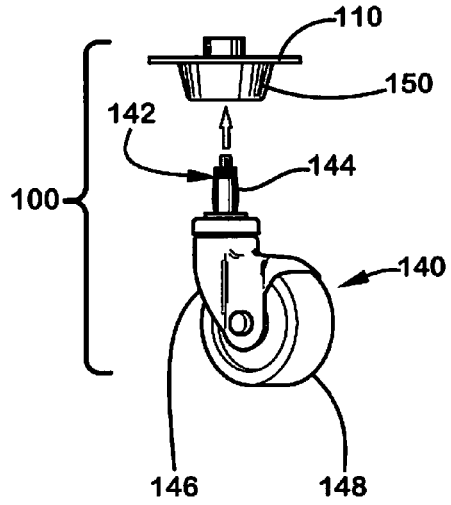
FIG. 8 is a partially-exploded perspective view of the detachable wheel of the present invention.

Rubber isolation foot 150, shown on FIG. 8, is widely commercially available, with the only difference between the commercially available unit and the foot 150 being that the latter has a larger central hole 152, which is one inch in diameter. The increased diameter of hole 32 is made by simply cutting out a portion of the rubber of foot 150 using well-known means.

Caster 140, also shown on FIG. 8, is an expansion stem caster with wheel locks, which is also commercially available, and is made, for example, from parts from Albion. It includes a stem 142, which has an adjustable rubber cover 144, and a bottom bracket 146, which holds wheel 148.

In order to use the detachable wheels 100, the amp riser 40 must be prepared by first cutting a circular hole of one and a quarter inches in diameter in the bottom face 50 of the riser 40. As described above, the bottom face 50 is made of an upper plywood sheet bonded to a lower black quad ripple polypropylene material. The plywood sheet, being only about one-half inches thick, is easily cut through.

Once the circular hole is cut, the top portion 120 of the caster plate 110 is inserted into the circular hole in the bottom face 50. Because of the similarity in the length of the top portion 120 with the thickness of the plywood sheet used in the bottom face 50, the top of the end cap 124 of the top portion 120 should ideally be flush with top of the bottom surface 50 upon insertion.

Next, the rubber isolation foot 150 is positioned against the bottom face of the disc 112 with the bottom portion 122 of the hollow cylinder 114 fitted through the foot's central hole 152. Four large screws, commercially available as No. 6 flat head, Phillips wood screws of five-eighths inch length, are then threaded down through the bottom face 50, through the large screw holes 116, and into the rubber foot 150.

The construction process is then completed by threading four small screws, commercially available as No. 10 Phillips, pan head tapping screws of five-eighths inch length, upwardly through the small screw holes 118 of the disc 112 and into the bottom face 50.

The above process is repeated until the desired number of caster plates 110 and Feet 150 are mounted on the bottom face 50. In this instance, four of each are used to make four detachable wheels 100 on the bottom of riser 40.

At this point the amp riser 40 is ready to be used with the detachable wheels 100. Without inserting the caster 140, the amp riser 40 can be used or stored with ease. The rubber isolation feet 150 can serve to further reduce or eliminate any residual vibrations that might pass through the acoustical elements of the riser 40 towards the stage on which the amp riser 40 is placed. When being moved about, the riser 40 is rotated onto its bottom lid 56 such that it is supported upon bottom lid wheel set 160. It is contemplated that wheel set 160 could be made up detachable wheels 100 if desired by the user or could be made from more standard non-removable casters 68.

For a more mobile use option, the casters 140 can be attached to the amp riser 40. To do this, the stem 142 of the caster 140 is inserted into the receiving socket 126 of one of the hollow cylinders 114. The caster bracket 146 is then turned in a clockwise direction for one to five turns until the stem 142 is tightly attached within the socket 126. The attachment occurs because the turning of the bracket 146 causes the rubber cover 144 to vertically contract along the stem 142 and expand horizontally against the inside of the cylinder 114. The process of inserting and tightening the casters 140 is repeated with the other sockets 126 until each of the sockets 126 on the bottom face 50 engages a caster 140. When the user desires to remove the casters 140, the process is simply reversed, with the casters 140 being unscrewed from the sockets 126.

Once the four casters 140 are inserted and the amp riser 40 is repositioned from the vertical to a horizontal orientation, the riser is easily movable about a stage, either empty or with an item such as an amplifier positioned on top of it. The rubber isolation feet 150, and to some extent the casters 140, serve to reduce the vibrations traveling through the riser 40 during movement and during use in performances. One of the important advantages of using the detachable wheels 100 rather than standard casters 68, or even caster 140 other than as part of the detachable wheels 100, is that the rubber isolation feet 150 help to reduce vibration through casters and onto a stage area more than casters alone. In addition, the placement of the rubber isolation feet 150 can serve to hide the holes used for the casters 140 that would otherwise be visible.

One method of using a single riser (for example, amp riser 40) with detachable wheels 100 begins by first removing the riser 40 from storage and rolling it vertically on its bottom lid wheel set 160 to a designated setup area, either on stage or backstage. Next, the casters 140 are inserted in the feet 150 and tightened into position. The riser 40 is then reoriented horizontally on the bottom face 50 and is supported by the detachable wheels 100 (with the inserted casters 140).

At this point, the riser 40 is moved into its final position on the stage. Top lid 60 and bottom lid 56 are removed. A power cable is attached to the riser 40 via the interface plate 80. The other end of the cable is then plugged into the appropriate power source. In applicable situations, lighting cables, audio returns, multi-pin cables, or other applicable cables are also attached to the interface plate 80. At some point, the music equipment (amps, microphones, etc.) are placed on the riser 40 and also connected to the interface plate 80. Once properly oriented on the stage, the riser 40 can be used to elevate performers, instruments, or other equipment. The interface plate 80 in the back of the riser 40 can be used to connect it to other equipment and even to other risers. The riser 40 can then be used for the applicable performance or performances. During the performance, the rubber of the feet 150 may have a spring effect that helps to stop unwanted vibrations. Also, the transparent face 72 will ideally be lit by the LED light panel 74 and will be exposed to the audience during the performance. It is also contemplated that the transparent face 72 can be backlit in any color or combination of colors by a lighting system.

When use of riser 40 is completed, the steps are reversed. The cables are detached from the interface plate 80, the equipment is removed from the riser 40, and the riser 40 is wheeled backstage (if necessary). The lids 56, 60 are replaced, and the riser 40 is raised so as to sit upon the bottom lid wheel set 160. After casters 140 are removed, the riser 40 is able to be placed back in storage or packed for transport to the next performance venue. The removal of the casters 140 from the isolation feet 150 also helps to save space during storage.

In another embodiment, the rigid block 20 can be used in other risers of different sizes than the amp riser 40. For example, these risers could include a drum riser or performance riser 200, both of which are larger than the amp riser 40.

Figure 9:
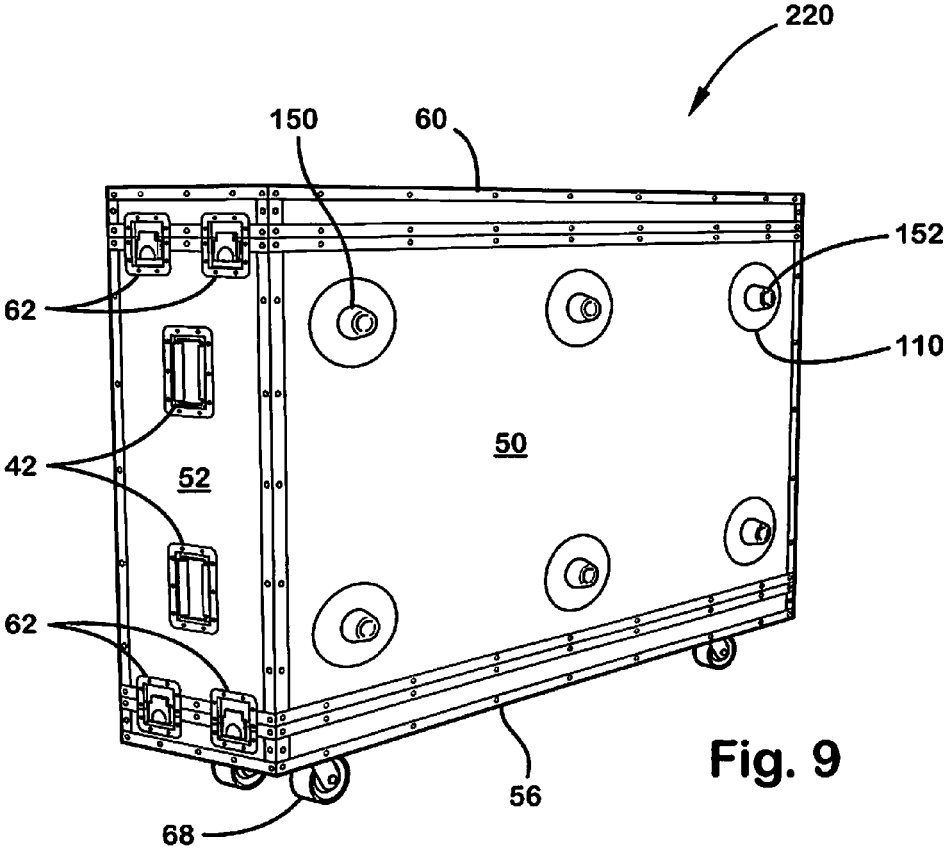
FIG. 9 is perspective view of a front section of a performance riser.
Figure 10:
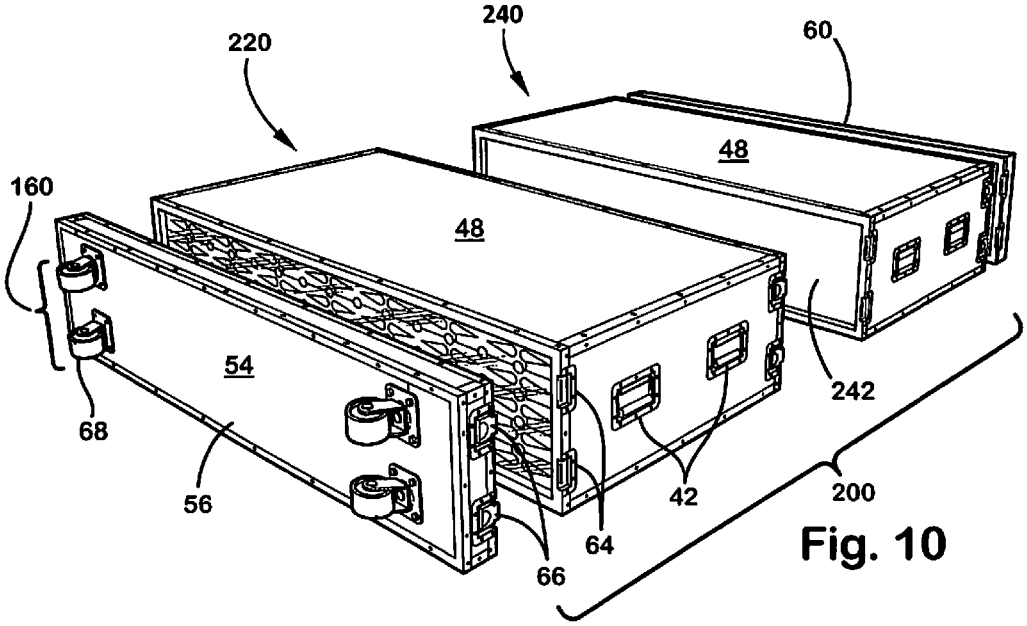
FIG. 10 is a partially-exploded perspective view of the performance riser of the present invention.

A view of the performance riser 200 is shown in FIG. 10. In one embodiment, in order to construct the performance riser 200 two major sections, a front section 220 and a rear section 240, are incorporated. Each of these sections 220, 240 is constructed very similarly to the amp riser 40. The greatest differences between the front section 220 (shown in FIG. 9) and the amp riser 40 is that the front section 220 is larger in size, incorporates six detachable wheels 100 on the bottom face 50 rather than four, includes four latches 62 rather than two, and has a plain rear face 212 (instead of the control panel face 78) on the rear of its main portion 58. Also, the plain rear face 212 of the front section 220 includes an XLR connector for the LED lighting cable. In use, the XLR connector connects to a short XLR extension cable which connects at its other end to a similar XLR connector on the rear section 240.

Similarly the rear section 240 is different from the amp riser 40 in that it is larger in size, has six detachable wheels 100 rather than four, includes four latches 62 rather than two, has no LED panel 74, and has a plain front face 242 on the front of its main portion 58 (rather than a transparent face 72). As discussed above, the plain front face 242 of the rear section 240 has an XLR connector that connects to the extension cable, and wiring through the main portion 58 that connects that XLR connector to the interface plate 80.

In order to use the performance riser 200 with detachable wheels 100, the front section 220 and rear section 240 of the performance riser 200 are first removed from storage and rolled on their bottom lid wheel sets 160 to a designated setup area, either onstage or backstage. Next, the casters 140 are inserted in the feet 150 and tightened into position. Twelve total casters 140 are inserted into the bottom faces 50 (six per section). The sections 220, 240 are then oriented horizontally on their bottom faces 50 and are supported by the six detachable wheels 100 each.

At this point, the sections 220, 240 are moved into final position on the stage. The top lids 60 and bottom lids 56 are removed from each section. The short XLR extension cable for the LED lighting is attached between sections 220 and 240. Next, the main portion 58 of front section 220 is connected to the main portion 58 of the rear section 240 via portions of the same latches 62 that are used to connect the main portion 58 and top lid 60 of the front section 220 and the main portion 58 and bottom lid 60 of the rear section 240. That is to say, the latch portion (66 or 64) of the main portion 58 of the front section 220 will naturally attach to the corresponding latch portion (66 or 64) of the main portion 58 of the rear section 240. This occurs because of the inverted nature of some of the latches 62 as described above. It is also contemplated that this use of the latches 62 in the inverted and opposed forms as described above could be done in other anvil-style hard cases, with or without tongue and groove valances. If tongue and grove valances are used in a riser 200, then the same tongue or groove that is used to secure the connection between the main portions and the lids, as described above, could also be used to secure the connections between the sections 220, 240 when they are combined.

Once the latches 62 are secured, the appropriate cables are attached to the rear interface plate 80 of the rear section 240 in a similar manner to the corresponding part of the amp riser 40 described above. Instrument(s), amplifier(s), and/or performer(s) are then positioned on the performance riser 200 and the performance occurs. Similarly to the amp riser, the transparent face 72 is lit up.

When use of the performance riser 200 is completed, the steps are reversed. The cables are detached from the interface plate 80, the equipment is removed from the riser 200, the two sections 220, 240 are detached from each other by undoing the latches 62, the short XLR extension cable is disconnected, and the sections 220, 240 are wheeled backstage (if necessary). The lids 56 and 60 are replaced onto each section 220, 240, and the sections 220, 240 are raised so as to sit upon their bottom lid wheel sets 160. After casters 140 are removed, the sections 220, 240 are able to be placed back in storage or packed for transport to the next performance venue.

The drum riser is made and used in virtually the same manner as the performance riser 200. The key differences are that the drum riser front and rear sections 220, 240 are larger than the corresponding sections for the riser 200 and have twelve detachable wheels 100 per set (rather than six). Other riser sizes are also contemplated.

These risers could be used in different sets and combinations for different performances. For example, one performance might incorporate a set of risers having two amp risers 40, and one of each of a drum riser and a performance riser 200, with each of the amp risers 40 being used to support an amplifier, the drum riser being used to support a drummer and a drum kit, and the performance riser 200 supporting one or two other performers and their instruments or equipment.

In a concert or other multiple-performance situations, risers that have detachable wheels 100 become even more valuable. In these situations, two or more riser sets (like, for example, two of the sets described above) are used in rotation to reduce the set-up time wasted between performances.

First, a first riser set is prepared for use as described above. Then, either before or while the first riser set is in use by a first performing group, a second riser set is prepared for use by a second performing group.

Once the first group is finished, the power, lighting, and/or audio cables are detached from the first riser set, and it is moved backstage. The second riser set is positioned onstage and, after the cables are reattached and the performers are in place, the second riser set is ready for use by the second performing group.

The process can then be repeated indefinitely, either by alternating between using the two riser sets for the third and subsequent performing groups (and changing out the applicable musical equipment for each group) or by having an additional riser set for each performing group.

It should be appreciated that the methods of using the risers described above could also be done, with some modifications, while using all standard casters 68 rather than detachable wheels 100. Additionally, it should also be appreciated that in many instances, the particular order of the steps is not crucial.

In some other embodiments, the musical performance risers may be intended to be used in variety of settings where the riser will not often be transported great distances. These risers, which are intended for use in locations that include churches, schools, performance halls, etc., are similar to risers described above except the hard anvil-style case 44 may be replaced by other sorts of casing material. These materials can be of a wide variety of types and can include painted or stained wood, laminate, or other materials of a variety of colors. Additionally, such features as the transparent face 72, or any of the other features described in the invention could be added or removed to fit the riser needs of a given performer or group. Ideally some of these risers will have features that are more geared toward artistic attractiveness than is found in the risers described above, which are more geared toward functionality.

These inventions have been described in this disclosure in various exemplary embodiments, but it will be understood by those having ordinary skill in this art that the disclosed inventions are not limited by this description. Various modifications and variations of the described embodiments may be made without departing from the scope of these inventions.

What is claimed is:

1. A portable musical performance riser comprising:

a top surface;

a bottom surface positioned below the top surface;

one or more side surfaces connecting the top surface and the bottom surface whereby an interior area is formed; a rigid block positioned within the interior area, the rigid block being defined by a plurality of foam layers; the plurality of foam layers including a first layer and a second layer, wherein the first layer is adjacent to the second layer, wherein the first layer has a higher density than the second layer; and wherein the plurality of layers is able to reduce the propagation of sound through the riser when the riser is used during a musical performance.

2. The riser of claim 1 further comprising a plurality of sonic suppression chambers formed in the rigid block such that the plurality of chambers reduce the propagation of sound through the riser.

3. The riser of claim 2, wherein each of the plurality of layers is comprised primarily of one or more foam materials having a density greater than 4 kg/m3 and less than 45 kg/m3.

4. The riser of claim 3, wherein each of the one or more foam materials is expanded polystyrene (EPS).

5. The riser of claim 2, wherein each of the plurality of sonic suppression chambers comprises a hole cut into the one or more foam materials, the hole including a first end and a second end.

6. The riser of claim 5, wherein at least one of said first layer and said second layer contains one or more sonic suppression chambers that are, except for their first ends and their second ends, entirely enclosed within said layer.

7. The riser of claim 5, wherein said first layer and said second layer contain one or more sonic suppression chambers that are, except for their first ends and their second ends, enclosed between the first layer and the second layer.

8. The riser of claim 5, wherein one or more of the sonic suppression chambers have one or more substantially raindrop-shaped vertical cross sections.

9. The riser of claim 5, wherein one or more of the sonic suppression chambers have one or more substantially circular-shaped vertical cross sections.

10. The sonic suppression chamber of claim 6, wherein one or more of the enclosed sonic suppression chambers includes a slit extending from the chamber's first end to the chamber's second and from the edge of the chamber to a face of the layer in which the chamber is enclosed.

11. The riser of claim 2, wherein said first layer is at least twice as dense as said second layer.

12. The riser of claim 1, wherein the rigid block fills substantially all of the interior area.

13. The riser of claim 2, wherein the combined volume of the plurality of sonic suppression chambers is greater than 5% but less than 50% of the entire volume of the rigid block.

14. The riser of claim 2, wherein the plurality of sonic suppression chambers includes more than 10 but less than 500 sonic suppression chambers.

15. The riser of claim 2, wherein the each of the plurality of layers has a top face that is substantially parallel to the top surface of the riser and a bottom face that is substantially parallel to the bottom surface of the riser.

16. The riser of claim 15, wherein the median thickness of the plurality of sonic suppression chambers is greater than one inch.

17. The riser of claim 15, wherein each one of the plurality of layers is more than two inches in thickness but less than twelve inches in thickness.

18. The riser of claim 1, further comprising an anvil-style hard outer casing.

19. A method of using the musical performance riser of claim 2 comprising the steps of:

placing the riser on a substantially flat surface with the top surface positioned above the bottom surface;

placing a drum set on the top surface of the riser; and playing the drum set while it is positioned on the riser, whereby the propagation of sound from the drum through the riser is reduced by the rigid block.

20. A musical performance riser comprising:

a main portion, the main portion including a top face and a bottom face, the top face being supported above the bottom face by two corresponding pairs of opposed sides faces, the first corresponding pair of opposed side faces including a first side face and a second side face, and the second corresponding pair of opposed side faces including a third side face and a fourth side face, and the main area further including an inner area formed between the faces;

a bottom lid, the bottom lid being removably attachable to the first side face by a plurality of latches;

a top lid, the top lid being removably attachable to the second side face by a second plurality of latches;

an LED light panel located within the interior area of the main portion in front of the third side face;

the fourth side face being transparent or translucent such that light from the LED light panel can pass through the third side face;

a control panel usable for controlling the LED light panel, the control panel being located on an outside surface of the third side face;

a rigid block positioned within the interior area, the rigid block including a first foam layer, a second foam layer positioned adjacent to and below the first foam layer, and a third foam layer positioned adjacent to and below the second foam layer, wherein second foam layer has a significantly different density from both the first foam layer and the second foam layer; and wherein the rigid block is able to reduce the propagation of sound through the riser when the riser is used during a musical performance.

* * * * *